United States Patent [19]

Patten

[11] 4,099,961

[45] Jul. 11, 1978

[54] CLOSED CELL METAL FOAM METHOD

[75] Inventor: James W. Patten, Kennewick, Wash.

[73] Assignee: The United States of America as represented by the United States Department of Energy, Washington, D.C.

[21] Appl. No.: 752,935

[22] Filed: Dec. 21, 1976

[51] Int. Cl.[2] ..... C22F 1/02; C22F 1/04; C22F 1/08; C22F 1/11

[52] U.S. Cl. ..... 75/20 F; 204/192 R; 428/613

[58] Field of Search ..... 75/208; 428/613; 204/192 C, 192 SP, 192 R; 264/0.5

[56] References Cited

U.S. PATENT DOCUMENTS

| | | | |
|---|---|---|---|
| 2,553,016 | 5/1951 | Sosnick | 75/20 F |
| 3,705,030 | 12/1972 | Berry, Jr. et al. | 75/20 F |
| 4,020,131 | 4/1977 | Feradag | 264/0.5 |

OTHER PUBLICATIONS

Kelley, R., et al. "Diffusion in Inert-Gas Bombarded Pt and Al."; Phys Stat Sol. vol. 13, No. 55, (1966), pp. 55-69.

Lee, W. et al.; Argon Entrapment in Metal Films by DC Triode Sputtering," Journal of Applied Physics vol. 46, No. 4, (Apr. 1975), pp. 1728-1732.

Blackman, A. G., et al.; "D. C. Bias Sputtered Aluminum Films", IBM Research (Jul. 27, 1972), RC 3952 pp. 1-12.

Mitchell, I. V. et al.; "Gas Incorporation in and Evaporated Gold Films", Vacuum vol. 21, No. 12, Pergaman Press Ltd. pp. 591-595.

Winters, H. F., et al. "Gas Incorporation Into Sputtered Films", Journal of Applied Physics, vol. 38, No. 10. (Sep., 1967), pp. 3928-3934.

Heim, G., et al.; "Ion Implanting During Film Growth and its Effect on the Superconducting Properties of Niobium", J. of App Phys, 25 vol. 46 (9/75) pp. 4006-4012.

*Primary Examiner*—L. Dewayne Rutledge
*Assistant Examiner*—Michael L. Lewis
*Attorney, Agent, or Firm*—Dean E. Carlson; Arthur A. Churm; James W. Weinberger

[57] ABSTRACT

Foamed metals and metal alloys which have a closed cellular structure are prepared by heating a metal body containing entrapped inert gas uniformly distributed throughout to a temperature above the melting point of the metal and maintaining the body at this temperature a period of time sufficient to permit the entrapped gas to expand, forming individual cells within the molten metal, thus expanding and foaming the molten metal. After cell formation has reached the desired amount, the foamed molten metal body is cooled to below the melting temperature of the metal. The void area or density of the foamed metal is controlled by predetermining the amount of inert gas entrapped in the metal body and by the period of time the metal body is maintained in the molten state. This method is useful for preparing foamed metals and metal alloys from any metal or other material of which a body containing entrapped inert gas can be prepared.

7 Claims, 2 Drawing Figures

CLOSED CELL METAL FOAM METHOD

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

This invention relates to foamed metals and to a method for making foamed metals and metal alloys. More specifically, this invention relates to foamed metals and metal alloys and to a method for making foamed metals and metal alloys which have a closed cellular structure.

Foamed metals and metal alloys, that is, metals and alloys which have a density less than that of the solid material, have a number of unique and desirable characteristics such as a high stiffness-to-density ratio, high damping characteristics, high impact resistance, and low thermal conductivity. Such materials are electrically conducting and can be fabricated by conventional metalforming techniques such as welding, brazing, etc.

Materials having these characteristics are useful in a number of applications: for example, materials having a high stiffness-to-density ratio, high damping coefficients and high impact resistance are desirable in aircraft components such as helicopter blades. High damping coefficients and high impact resistance will be useful in preparing a lightweight armor, while material having high resistance to external pressure would be excellent for preparing structural components for deep-sea equipment. A hydrogen storage cell of foamed titanium would permit the storage of a large quantity of hydrogen as titanium hydride, and a nuclear reactor fuel such as a foamed plutonium alloy would permit a compact reactor power source by allowing room within the fuel element for swelling and gas formation.

SUMMARY OF THE INVENTION

A method has been developed by which foamed metals and metal alloys having controlled density and closed cellular structure can be prepared. By the method of the invention, a metal or metal alloy body containing atoms of entrapped inert gas evenly distributed throughout is prepared. The metal body containing the entrapped gas is then heated to a temperature above the melting temperature of the metal or metal alloy and maintained at this temperature for a period of time sufficient to permit the entrapped gas to expand within the molten metal body to form individual cells and to attain the desired reduced density. Once the desired density has been attained, the metal body is cooled to below the melting temperature of the metal, thereby forming a foamed body of the desired density having a closed cellular structure.

The metal or metal alloy body containing the entrapped inert gas may be best prepared by sputter deposition of the desired metal or alloy under an inert gas atmosphere and under conditions which will entrap the insert gas in the sputtered deposit.

It is therefore one object of this invention to provide foamed metals and metal alloys having a closed cellular structure.

It is another object of the invention to provide foamed metals and metal alloys having a closed cellular structure and a predetermined reduced density.

It is a further object of the invention to provide a method for preparing foamed metals and metal alloys having a closed cellular structure.

Finally, it is the object of the invention to provide a method for preparing foamed metals and metal alloys having a closed cellular structure in which the density of the metals can be predetermined.

DETAILED DESCRIPTION OF THE PREFERRED EMBODIMENT

Figure 1:
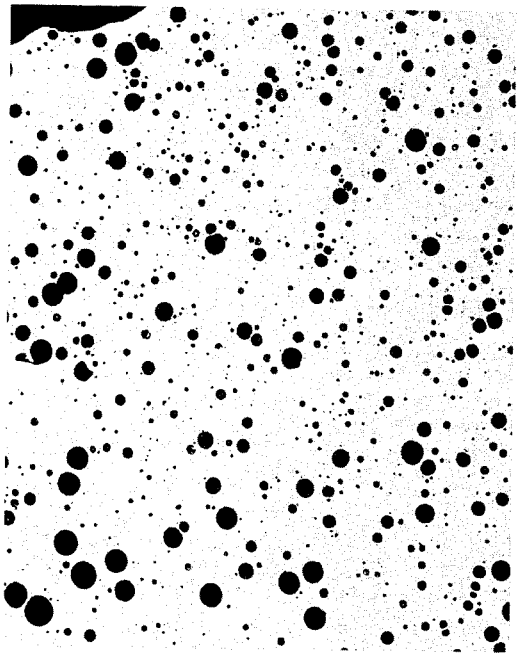
FIG. 1 is a 100x metallograph of a section of closed cell foamed aluminum prepared from a sputter-deposited aluminum body containing 272 ppm argon.

These and other objects of the invention may be met by sputtering a metal or metal alloy to be foamed, under a partial pressure of inert gas, onto a substrate, which is cooled and which has a negative electrical bias, to prepare a metal body containing from about 10 to 2300 ppm entrapped atoms of inert gas evenly distributed therethrough, removing the body from the substrate, heating the body containing the entrapped gas to a temperature above the melting temperature of the metal or alloy to melt the metal or alloy, maintaining the temperature of the body for a period of time sufficient to permit the entrapped gas to expand and form individual cells within the body until the desired density is attained, and cooling the body to a temperature below the melting temperature of the metal, thereby forming a foamed metal or alloy body of the desired density having a closed cellular structure.

Any metal or metal alloy capable of forming a rigid structure can be foamed by the method of this invention. That is, any metal but mercury and some of the alkali metals and all metal alloys from which metal bodies containing entrapped gases can be prepared.

While the metal or metal alloy bodies containing the inert gas may be prepared by any method known to those skilled in the art by which inert gases may be entrapped and uniformly distributed within a metal body, the most effective method presently known for preparing such metal bodies is by sputter deposition. Thus a further limitation on the method of the invention for preparing foamed metals and alloys is that such materials must be capable of being sputtered; however, there is no known limit to the number of different metals and alloys which can be sputtered.

The entrapment of argon in a number of metal films was discussed in an article by W. W. Y. Lee and Daniel Oblas beginning on page 1728 of the Journal of Applied Physics, Vol. 46, No. 4, April 1975. The metals disclosed in that article in which argon entrapment occurred included aluminum, titanium, chromium, nickel, copper, niobium, silver, hafnium, molybdenum, tantalum, tungsten, platinum and gold. There are many other metals, not included in the article, which can be sputter-deposited to entrap an inert gas, including silicon, iron and plutonium. Thus continued deposition of any of these metals to form bodies of the required size and thickness containing controlled amounts of entrapped inert gas is well known in the art.

The particular sputtering apparatus by which deposition of the metal or metal alloy to form the body containing the entrapped gas can be made is not critical, although the deposition should be at such a rate that the use of the method is feasible. One type of sputtering apparatus which was found to give a high rate of deposition and good control of the amount of gas to be entrapped is the triode sputtering apparatus where the plasma is formed independently as the positive column of a discharge maintained between a thermionic cathode and an anode and which has a cooled substrate with a controllable negative bias. Sputtering is accomplished by inserting a target of the metal or alloy to be foamed into this plasma as a separate negative electrode. The advantage of this apparatus is that high-purity deposits and a high sputtering rate are achievable. A schematic diagram of one such sputtering apparatus is shown on page 3 of BNWL-553, Application of Sputtering to the Fabrication of Neutron Detector Anodes, E. D. McClanahan, R. W. Moss and R. Busch, November 1967. The partial pressure may vary from 1 to about 200 microns and is best achieved by evacuating the reactor gases present in the sputtering apparatus and back-filling the apparatus with an inert gas which will support a plasma such as krypton, argon, xenon, helium, nitrogen or oxygen.

The entrapment of gases in sputtered deposits during sputter deposition is discussed in the article by W. W. Y. Lee and Daniel Oblas described earlier and an article by A. G. Blachman, IBM Research Report, RC 3952, IBM, Thomas J. Watson Research Center, P. O. Box 218, Yorktown Heights, New York (1972). Control of the amount of inert gas entrapped in the sputtered deposit depends upon the sputtering equipment and the material being sputtered, but is generally controlled by varying the pressure of the inert gas in the deposition chamber, the temperature of the substrate and the amount of negative bias voltage placed on the substrate. For example, while the amount of gas retained in the sputtered deposit is a function of decreasing substrate temperature, it is also dependent upon the material sputtered. Thus substrate temperatures from 0° to 50° C proved satisfactory for varying amounts of argon entrapped in aluminum, while a substrate temperature of 195° C provided 2300 ppm of krypton in a sputtered plutonium body. Gas retention in the sputtered deposit is also a function of increasing negative substrate bias which will again vary depending upon the particular equipment. With the equipment described herein, a negative bias of from −35 to −150 V was satisfactory. The exact conditions under which the inert gas will be entrapped in the sputtered metal or alloy as it is deposited upon the substrate and the exact conditions which will control the rate at which the gas is entrapped in the sputtered metal and which will ultimately determine the amount of gas which is entrapped in the metal will depend upon the particular sputtering apparatus which is being used. Thus the operation of some equipment may involve the control of conditions other than those hereinbefore enumerated as being controlling in the particular triode apparatus involved.

The amount of gas to be entrapped within the substrate will depend directly upon the degree of foaming or the amount of void formation which is desired in the final foamed product. It has been found that the amount of entrapped gas in the sputtered body can vary from 15 parts per million (ppm) to as high as about 25% in an amorphous material; however, a range of from about 15 to about 2300 ppm has permitted the formation of void volume fractions in metal from several percent up to about 80%. Formation of this void volume is also dependent upon the amount of time the body remains above melting temperature as will be hereinafter discussed.

Heating of the metal body containing the entrapped gas may be accomplished by any means known to those skilled in the art which can heat the body to a temperature above the melting point of the metal in the body. Heating means will also depend upon the thickness of the body to ensure that uniform rapid heating of the entire body is obtained. Such heating means may include joule heating, radiant heating, inductive heating, capacitor bank, and DC or RF resistance heating. For materials which have very high melting temperatures such as tungsten, for example, it may be necessary to use specialized furnaces which have been described in the literature, such as levitation melting.

The body must be heated to a temperature above the melting temperature of the metal or alloy so that the metal becomes just molten and viscous enough so that the bubbles of gas can form and expand. While the particular temperature will depend upon the metal or alloy to be foamed, generally a temperature from 10° to 50° C. above the melting point of the metal was found adequate.

In addition to the amount of gas entrapped in the sputtered metal body, the most important aspect of the formation of the closed cellular structure in the body is the length of time at which the body is maintained at a temperature above the melting temperature of the metal or alloy in the body. This is important in determining not only the amount of void fraction formation but also determining the type of cellular structure, since the longer the period of time at which the body is maintained above the melting temperature, the fewer the cells which will be formed and the larger their size will be, since this will allow time for a number of small cells to coalesce. Relatively shorter periods of time under melting conditions will result in a larger number of individual relatively small cells in the metal. The exact time necessary to achieve a particular result will depend upon the physical characteristics of the particular molten metal or metal alloy, the amount of gas entrapped in the sputtered metal body and the cellular structure and void area desired.

While it is not necessary to cool the body rapidly to a temperature below the melting temperature of the metal in the body, it is a convenience to do so, since once again it is the length of time above the melting temperature which affects the cell structure and the total void fraction of the foamed metal. Cooling may be accomplished by any convenient method such as air cooling or quenching in water or with an appropriate cryogenic gas.

The following examples are given as illustrative of the method of the invention for preparing foamed metal and for closed cell foamed metals and are not to be taken as limiting the scope of the invention. On the contrary, it is intended to cover all alternatives, modifications and equivalents as can be included within the spirit and scope of the invention as defined in the appended claims. For example, the invention is useful as a method for preparing metal foams from any metal which can be sputter deposited to entrap an inert gas in order to prepare a metal body containing an inert gas uniformly distributed therethrough.

EXAMPLE I

Four sputter deposition experiments were conducted with each experiment producing a 12.7 cm diameter disc of sputtered aluminum, using a triode sputtering apparatus similar to that described in the references of McClanahan et al. Sputter deposition parameters, deposit thickness, and argon content are indicated in Table I below.

TABLE I

| Experiment Number | Target Potential (volts) | Target Current (amps) | Sputter Deposition Parameters and Results: Substrate Bias (volts) | Substrate Current (amps) | Argon Pressure ($\times 10^{-3}$ torr) | Substrate Temperature (° C) | Deposit Thickness (mm) | Argon Content* (ppm) |
|---|---|---|---|---|---|---|---|---|
| #1 | 2000 | 1.5 | Floating | 0 | 6.2 | 21 | 0.2 | 30 |
| #2 | 2000 | 1.75 | −100 | 1.9 | 6.2 | 21 | 0.9 | 231 |
| #3 | 2000 | 1.75 | − 60 | 1.75 | 6.2 | 21 | 0.6 | 23 |
| #4 | 2000 | 1.75 | −150 | 1.75 | 6.2 | 21 | 0.6 | 272 |

*Argon content was measured by vacuum fusion techniques with gas composition measured with a quadrupole mass spectrometer.

In operation, the chamber was evacuated to $3 \times 10^{-8}$ torr to test system integrity. High-purity argon was then admitted to the chamber while continuously pumping to maintain a pressure of $6.2 \times 10^{-3}$ torr. Next a plasma was ignited, and the high-purity aluminum substrate on which deposition was to take place was ion-bombardment etched at −100 volts substrate potential and 0.5 amp current for 5 minutes. Potential of the target was then adjusted to −2000 volts, the appropriate bias voltage was placed on the substrate, and the deposition experiment was initiated. Upon completing the deposition, the substrate (with deposit attached) was removed from the sputtering chamber and machined away from the deposit. No machining lubricant or coolant was used, so that a clean free-standing sputtered disc of aluminum resulted from each of the experiments.

The furnace which was used heated the samples by radiant heating and heating was done in either an air or nitrogen environment.

The discs described in Table I were cut into a number of samples 1 cm long, 0.10 cm × 0.05 cm and heated radiantly in a furnace to a temperature (about 700° C.) above the melting point of aluminum (660° C.), as shown in Table II, held there for several seconds and air-cooled. The cooled samples were then removed from the furnace and evaluated to determine the amount of foaming which took place. The results of the evaluation are given in Table II below. The first digit of the specimen number is the experiment number from Table I. FIG. 1 is a metallograph taken from a section of Experiment #4, described in Table II as specimen 4G.

TABLE II

| Specimen Number | Mean Cell Size (μ) | Median Cell Size (μ) volume | Cell$_3$ Count/cm$^3$ | Cell Vol. Fraction (%) | Cell Specific Surface Area (cm$^2$/cm$^3$) | Argon Content (ppm) | Specimen Width* (mm) | Specimen Thickness* (mm) | Time Above Melting Point (sec) |
|---|---|---|---|---|---|---|---|---|---|
| 1-A-1 | 4.04 | 4.65 | $2.65 \times 10^8$ | 0.60 | $1.48 \times 10^2$ | | | | |
| 1-A-2 | 3.56 | 3.70 | $2.24 \times 10^8$ | 0.60 | $1.90 \times 10^2$ | 30 | 1.1 | 0.2 | 42 |
| 1-A-3 | 2.91 | 2.95 | $3.75 \times 10^8$ | 0.28 | $1.05 \times 10^2$ | | | | |
| 1-G-1 | 4.15 | 9.10 | $2.07 \times 10^8$ | 1.29 | $1.81 \times 10^2$ | | | | |
| 1-G-2 | 4.25 | $1.02 \times 10^1$ | $2.19 \times 10^8$ | 1.33 | $1.75 \times 10^2$ | 30 | 4.2 | 0.2 | 21 |
| 1-G-3 | 4.05 | 8.15 | $1.57 \times 10^8$ | 0.66 | $1.09 \times 10^2$ | | | | |
| 2-A-1 | 3.58 | 5.20 | $1.48 \times 10^8$ | 0.31 | $7.23 \times 10^1$ | | | | |
| 2-A-2 | 4.41 | $1.29 \times 10^1$ | $6.30 \times 10^7$ | 0.60 | $6.24 \times 10^1$ | 231 | 1.1 | 0.9 | 14 |
| 2-A-3 | 4.70 | 8.15 | $8.80 \times 10^7$ | 0.51 | $8.01 \times 10^1$ | | | | |
| 3-A-1 | 5.65 | $2.53 \times 10^1$ | $8.92 \times 10^7$ | 3.62 | $1.93 \times 10^2$ | | | | |
| 3-A-2 | 5.80 | $3.18 \times 10^1$ | $9.90 \times 10^7$ | 4.42 | $2.15 \times 10^2$ | 23 | 1.1 | 0.6 | 8 |
| 3-A-3 | 3.77 | $1.15 \times 10^1$ | $7.00 \times 10^7$ | 0.32 | $4.37 \times 10^1$ | | | | |
| 4-A-1 | 3.88 | $3.56 \times 10^1$ | $6.77 \times 10^8$ | 6.77 | $5.03 \times 10^2$ | | | | |
| 4-A-2 | 4.30 | $7.87 \times 10^1$ | $5.20 \times 10^8$ | 16.37 | $5.89 \times 10^2$ | 272 | 1.1 | 0.6 | 24 |
| 4-A-3 | 2.95 | 3.70 | $1.16 \times 10^8$ | 0.11 | $3.51 \times 10^1$ | | | | |
| 4-G-1 | 5.82 | $2.02 \times 10^1$ | $2.12 \times 10^8$ | 5.18 | $3.83 \times 10^{12}$ | | | | |
| 4-G-2 | 5.68 | 9.10 | $2.29 \times 10^8$ | 2.11 | $2.96 \times 10^2$ | 272 | 4.0 | 0.6 | 21 |
| 4-G-3 | 6.41 | $1.44 \times 10^1$ | $2.54 \times 10^8$ | 4.51 | $4.23 \times 10^2$ | | | | |
| 1-B-1 | 4.44 | 7.30 | $2.55 \times 10^8$ | 1.15 | $1.99 \times 10^2$ | | | | |
| 1-B-2 | 3.19 | 4.15 | $2.30 \times 10^8$ | 0.32 | $8.45 \times 10^1$ | 30 | 1.1 | 0.2 | |
| 1-B-3 | 3.67 | 4.65 | $2.27 \times 10^8$ | 0.44 | $1.11 \times 10^2$ | | | | |
| 1-H-1 | 3.52 | 4.65 | $1.40 \times 10^8$ | 0.24 | $6.28 \times 10^1$ | | | | |
| 1-H-2 | 3.46 | 4.65 | $2.17 \times 10^8$ | 0.41 | $9.58 \times 10^1$ | 30 | 4.2 | 0.2 | |
| 1-H-3 | 5.34 | $1.02 \times 10^1$ | $1.36 \times 10^8$ | 1.38 | $1.73 \times 10^2$ | | | | |
| 2-B-1 | 5.38 | $7.87 \times 10^1$ | $2.25 \times 10^8$ | 17.28 | $4.50 \times 10^2$ | | | | |
| 2-B-2 | 4.46 | $6.27 \times 10^1$ | $5.75 \times 10^8$ | 8.93 | $5.53 \times 10^2$ | 231 | 1.1 | 0.9 | |
| 2-B-3 | 3.98 | $2.02 \times 10^1$ | $1.05 \times 10^9$ | 6.67 | $7.29 \times 10^2$ | | | | |
| 3-B-1 | 5.48 | 9.10 | $4.11 \times 10^8$ | 3.54 | $4.95 \times 10^2$ | | | | |
| 3-B-2 | 5.15 | 7.30 | $3.61 \times 10^8$ | 2.26 | $3.68 \times 10^2$ | 23 | 1.2 | 0.6 | |
| 3-B-3 | 4.24 | 5.20 | $2.51 \times 10^8$ | 0.66 | $1.56 \times 10^2$ | | | | |
| 4-B-1 | 3.67 | 5.80 | $1.58 \times 10^8$ | 0.37 | $7.96 \times 10^1$ | | | | |
| 4-B-2 | 4.46 | 9.10 | $1.31 \times 10^8$ | 0.74 | $1.08 \times 10^2$ | 272 | 1.1 | 0.6 | |
| 4-B-3 | 4.14 | $1.02 \times 10^1$ | $1.13 \times 10^8$ | 0.65 | $8.41 \times 10_1$ | | | | |
| 4-H-1 | 5.08 | $1.29 \times 10^1$ | $2.66 \times 10^8$ | 2.81 | $3.12 \times 10^2$ | | | | |
| 4-H-2 | 5.03 | $3.18 \times 10^1$ | $1.85 \times 10^8$ | 4.84 | $2.84 \times 10^2$ | 272 | 4.0 | 0.6 | |
| 4-H-3 | 4.87 | $3.99 \times 10^1$ | $1.69 \times 10^8$ | 4.88 | $2.49 \times 10^2$ | | | | |

*All specimens were 1 cm long.

EXAMPLE II

Figure 2:
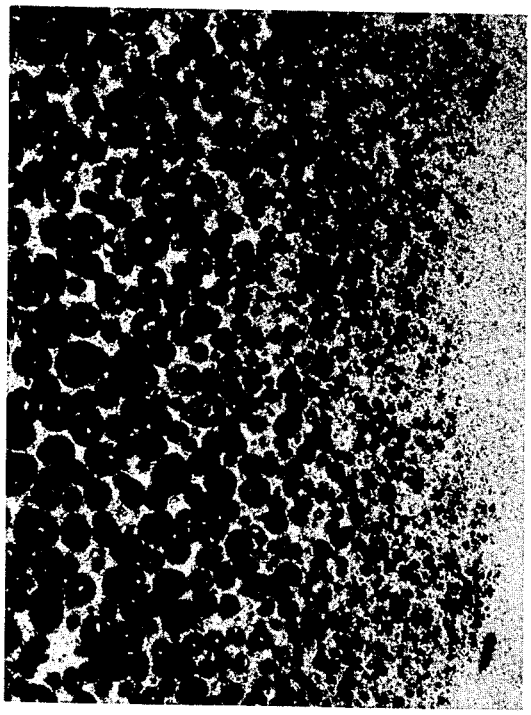
FIG. 2 is a 100x metallograph of a section of closed cell foamed plutonium prepared from a sputter-deposited plutonium body containing 2300 ppm krypton.

A plutonium body was sputter deposited as described previously under a partial pressure of 3 microns krypton using a target potential of −2000 V at 4.1 amps, and a substrate bias of −35 V. The substrate was maintained at a temperature of 195° C. The sputtered body was about 2 mils thick and contained 2300 parts per million krypton. The body was placed between two beryllium oxide blocks and heated by capacitor bank discharge to about 700° C. The body remained above the melting temperature of plutonium for 10 to 15 microseconds. A metallograph of the results of this example is shown in FIG. 2.

It should be noted that the method of this invention can be used to prepare close-celled foams from materials other than metals and metal alloys, and in fact can be used to prepare foams from any material which can be sputterdeposited to form a body containing uniformly distributed entrapped inert gas. Such non-metallic materials include silicon, glasses, for example, borosilicate, including Pyrex® and lead glasses; crystalline non-metallic materials, for example, alumina, zirconia and quartz; and semiconductor materials, for example, barium titanate, potassium hydrogen phosphate, lithium tantalum oxide, strontium tantalum oxide and tungsten oxide. The method of preparing foams of these materials consists of sputter-depositing the materials under conditions which will form bodies of the materials containing desired amounts of entrapped inert gas and heating the bodies to a temperature slightly above the melting temperature or softening temperature for glasses of the material for a period of time sufficient to permit the entrapped gas to expand and form the closed cellular structure in the material.

As can be seen from the preceding discussion and examples, the method of this invention is useful for preparing foamed material having a closed-cellular structure from many different types of materials including both metallic and non-metallic materials.

The embodiments of the invention in which an exclusive property or privilege is claimed are defined as follows:

1. Method for preparing a metal or metal alloy foam body having a closed cellular structure comprising:

a. preparing, by sputter deposition, a solid metal or metal alloy body containing entrapped atoms of inert gas evenly distributed throughout the body;

b. heating the body containing the entrapped gas to a temperature slightly above the melting temperature of the metal;

c. maintaining the temperature for a period of time sufficient to permit the entrapped gas to expand within the molten body to form individual cells of expanded entrapped gas; and d. cooling the body containing the entrapped expanded gas to below the melting temperature of the metal, thereby forming a metal foam body having a closed cellular structure.

2. The method of claim 1 wherein the metal is selected from the group consisting of aluminum, titanium, chromium, nickel, copper, niobium, molybdenum, silver, hafnium, tantalum, tungsten, platinum, gold, iron and plutonium.

3. The method of claim 2 wherein the body contains from about 15 to 2300 ppm of inert gas and the body is heated to 10° to 50° above the melting temperature of the metal.

4. The method of claim 2 wherein the body is sputter-deposited aluminum, the body contains from 15 to 2300 ppm of inert gas and is heated to about 700° C.

5. The method of claim 4 wherein the heated body is maintained above the melting temperature of aluminum for from about 8 to about 42 seconds.

6. The method of claim 2 wherein the body is sputter-deposited plutonium, the body contains 15 to 2300 ppm of inert gas and is heated to about 700° C.

7. The method of claim 6 wherein the heated body is maintained above the melting temperature of plutonium from about 10 to 15 microseconds.

* * * * *